US008898976B2

(12) United States Patent
Rosenthal et al.

(10) Patent No.: US 8,898,976 B2
(45) Date of Patent: Dec. 2, 2014

(54) WALLBOARD CORNER FINISHING STRIP

(71) Applicant: United States Gypsum Company, Chicago, IL (US)

(72) Inventors: Guy Rosenthal, Wheaton, IL (US); Kevin Moyer, Park Ridge, IL (US); James Carey, Plainfield, IL (US)

(73) Assignee: United States Gypsum Company, Chicago, IL (US)

( * ) Notice: Subject to any disclaimer, the term of this patent is extended or adjusted under 35 U.S.C. 154(b) by 0 days.

(21) Appl. No.: 13/804,890

(22) Filed: Mar. 14, 2013

(65) Prior Publication Data

US 2014/0096464 A1 Apr. 10, 2014

Related U.S. Application Data

(60) Provisional application No. 61/710,276, filed on Oct. 5, 2012.

(51) Int. Cl.
*E04B 2/00* (2006.01)
*E04F 13/06* (2006.01)

(52) U.S. Cl.
CPC ..... *E04F 13/06* (2013.01); *E04F 2013/063* (2013.01)
USPC ..... 52/287.1; 52/255

(58) Field of Classification Search
CPC ..... E04F 13/06; E04F 13/068; E04F 19/02; E04F 19/022; E04F 19/028; E04F 19/061; E04F 19/064; E04F 2013/063
USPC ..... 52/254, 255, 256, 257, 272, 287.1, 52/288.1, 717.03, 717.04, 717.05
See application file for complete search history.

(56) References Cited

U.S. PATENT DOCUMENTS

| | | | | |
|---|---|---|---|---|
| 3,109,207 | A | 11/1963 | Cooper | |
| 5,047,474 | A * | 9/1991 | Rabinovich et al. | 525/71 |
| 5,313,755 | A | 5/1994 | Koenig | |
| 5,442,886 | A | 8/1995 | Iacobelli | |
| 5,604,001 | A | 2/1997 | Schold | |
| 5,613,335 | A | 3/1997 | Rennich et al. | |
| 5,687,523 | A | 11/1997 | Stough | |
| 5,934,034 | A | 8/1999 | Yahiro | |
| 6,119,420 | A * | 9/2000 | Koenig et al. | 52/255 |
| 6,148,573 | A * | 11/2000 | Smythe, Jr. | 52/255 |
| 6,684,586 | B1 | 2/2004 | Hoffmann, Sr. | |
| 6,691,476 | B1 | 2/2004 | Kunz | |

(Continued)

FOREIGN PATENT DOCUMENTS

EP 1022406 7/2000

OTHER PUBLICATIONS

PCT Search Report for International Application No. PCT/US2013/060576, dated Feb. 20, 2014.

*Primary Examiner* — Jessica Laux
(74) *Attorney, Agent, or Firm* — Greer, Burns & Crain, Ltd.; Pradip Sahu; Philip T. Petti

(57) ABSTRACT

A corner bead strip is provided for finishing a wallboard corner joint, includes a flexible plastic body having a first flange and a second flange, each flange with a corner edge and an opposite free edge. The corner edges are joined by a central flex zone formed by a plastic composition distinct from a plastic composition used for forming the flanges. A web of paper covers a surface of the body.

8 Claims, 2 Drawing Sheets

(56) References Cited

U.S. PATENT DOCUMENTS

| | | | | |
|---|---|---|---|---|
| 6,691,477 | B2 | 2/2004 | Koenig. Jr. et al. | |
| 6,722,550 | B1 | 4/2004 | Ricordi et al. | |
| 6,779,313 | B2 | 8/2004 | Smythe, Jr. | |
| 7,141,284 | B2 | 11/2006 | Newton et al. | |
| 7,165,373 | B2 * | 1/2007 | Smythe, Jr. | 52/746.1 |
| 7,383,668 | B1 * | 6/2008 | Kunz | 52/255 |
| 2003/0024188 | A1 | 2/2003 | Smythe | |
| 2006/0236626 | A1 | 10/2006 | Smythe | |
| 2006/0283115 | A1 | 12/2006 | Robertson | |
| 2007/0122593 | A1 | 5/2007 | Conboy | |
| 2007/0260006 | A1 * | 11/2007 | Whitson et al. | 524/502 |
| 2008/0066403 | A1 * | 3/2008 | Koenig et al. | 52/255 |
| 2008/0256886 | A1 | 10/2008 | Goldman | |
| 2009/0184148 | A1 | 7/2009 | Dittrich et al. | |
| 2011/0023392 | A1 * | 2/2011 | Rosenthal et al. | 52/255 |

* cited by examiner

WALLBOARD CORNER FINISHING STRIP

RELATED APPLICATION

The present application claims 35 USC 119(e) priority from U.S. Provisional application Ser. No. 61/710,276 filed Oct. 5, 2012.

BACKGROUND

The present invention relates generally to interior wall construction products, and more specifically to apparatus used for finishing corners created by adjacent edges of wallboard sheets.

In conventional interior construction, wallboard or drywall panels are secured to a framework of vertically and horizontally arranged frame members, typically wood or metal. Abutting edges of adjacent wallboard panels are finished using a combination of wallboard joint tape and wallboard joint compound as is well known in the art. When adjacent wallboard panels are configured to form corners, corner bead products are often installed for both aesthetics and utility. Corner beads are more commonly used on outside corners, but there has been some development of corner beads for inside corners as well.

Corner beads finish a rough corner into a pleasing symmetrical transition with the respective adjoining walls, and also provide some resistance to abuse and impact on the corner. To accomplish these tasks, a suitable corner bead product should fit snugly on the wall, be easy to attach, and have material and design properties that allow it to resist at least minor impacts without severe damage or detachment from the wall.

Conventional corner bead strips are either made of metal or various types of plastic, and are provided in relatively rigid lengths or in flexible rolls. Flexible corner bead strips are typically two types. In the first type, 2 metal strips approximately 0.010-0.015 inch thick are disposed parallel to each other, are laminated to a web of paper with a slight separation gap between the strips so that the strip may be flexed as desired to match the corner profile. The flex bead strips are then applied to the wall corner and secured using wallboard joint compound. Disadvantages of conventional flexible metal corner bead strips include that the metal is relatively heavy, expensive, is easily bent or kinked, and is often difficult to straighten completely when provided in rolled form. In addition, due to the gap between the adjacent strips, it is sometimes difficult to obtain a straight or plumb corner edge, and also the actual corner of the wall is only protected by paper, and as such is prone to impact damage. Conventional flexible plastic corner bead strips suffer from the same susceptibility to impact damage at the wall corner.

Plastic corner bead strips can be made from a single strip of flexible plastic that is laminated to a paper web. Compared to the above-described metal strips, plastic corner strips are thicker, about 0.25 to 0.55 inch, to provide comparable rigidity to metal. However, the profile of the plastic strip is thinner near the centerline, to facilitate flexing for conforming to the corner profile.

One design criteria of flexible plastic corner bead strips is that a compromise is usually needed between a plastic that is sufficiently rigid for protecting the corner, which may include gaps between the wallboard edges, but sufficiently flexible for conforming to the wall without pulling away from the wall due to inherent bias of the strip to remain generally planar.

SUMMARY

The above-identified design criteria are addressed by the present flexible plastic corner bead strip, which is provided in a rolled up format for easier shipping and handling. The present corner bead strip can be easily cut to length and is sufficiently flexible to accommodate wall corner angles between about 30 to about 180 degrees. A feature of the present corner bead strip is that it is made non-homogeneously, using at least two plastic materials having distinct properties. A first plastic material is used for forming the flanges or wings of the corner bead strip, and a second plastic material is used for forming the central flexing region that joins the two flanges. In the preferred embodiment, the second plastic material is relatively more flexible than the first material. This additional flexibility is obtained in one example by introducing impact resistance modifiers in the second material to make it more flexible. Alternately, fillers are optionally added to the first material to make it less flexible. Also, the central flexing region is provided with a generally "V"-shaped recess in transverse cross-section, that extends along the longitudinal axis of the strip. This recess facilitates the conformation of the bead strip about the profile of the wall corner.

More specifically, a corner bead strip is provided for finishing a wallboard corner joint, includes a flexible plastic body having a first flange and a second flange, each flange with a corner edge and an opposite free edge. The corner edges are joined by a central flex zone formed by a plastic composition distinct from a plastic composition used for forming the flanges. A web of paper covers a surface of the body.

In another embodiment, a corner bead strip is provided for finishing a wallboard corner joint. The strip includes a flexible plastic body including a first flange and a second flange, each flange having a corner edge and an opposite free edge, the corner edges being joined by a central flex zone. The flex zone is formed by a plastic composition distinct from a plastic composition used for forming the flanges, and the flex zone is provided with a "V"-shaped recess for enhancing conformation about a wall corner. A web of paper covers a surface of the body. Each flange tapers and has a thickness in the range of 0.40-0.55 inch near the corner edge and a thickness in the range of 0.015-0.035 inch near the free edge, the thickness including dimensions of the paper and adhesive joining the paper to the flanges.

DETAILED DESCRIPTION

Figure 1:
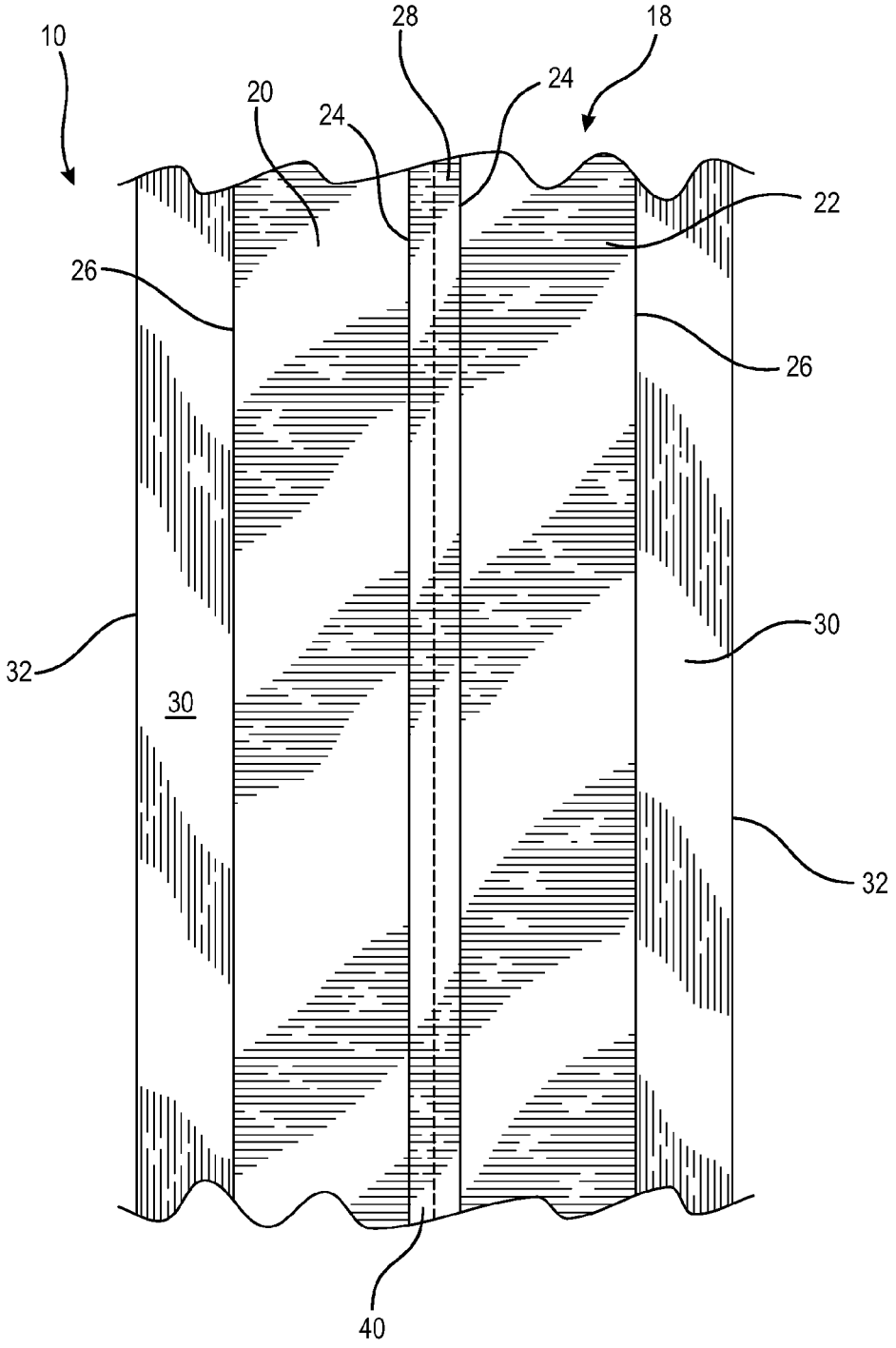
FIG. 1 is a front elevation view of the present corner bead strip.
Figure 2:
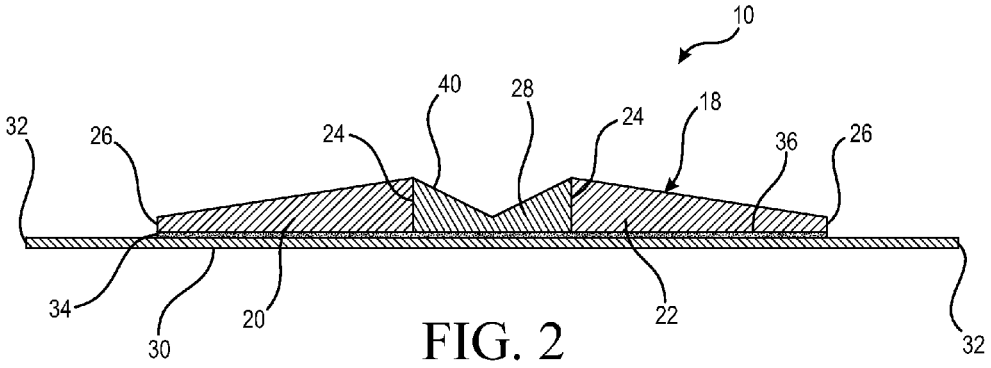
FIG. 2 is a cross-section taken along the line 2-2 of FIG. 1 and in the direction generally indicated.
Figure 3:
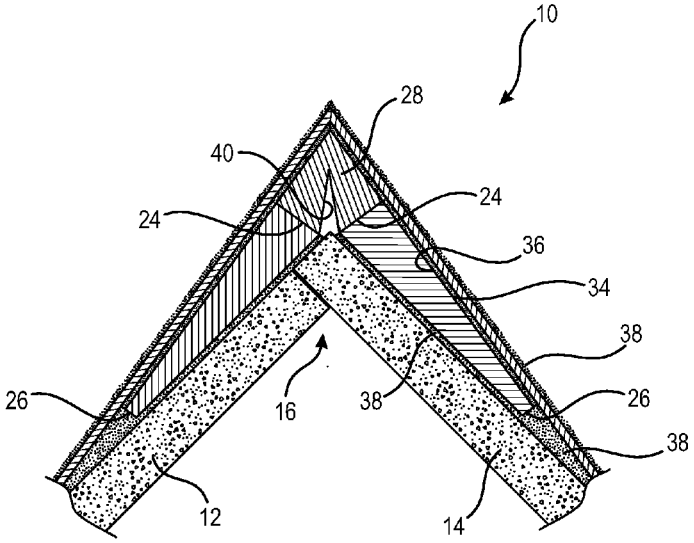
FIG. 3 is a similar cross-section showing the present corner bead strip secured to a wallboard corner.

Referring now to FIGS. 1-3, the present corner bead strip is generally designated 10, and is constructed and arranged to be positioned on a corner joint defined by edges of adjacent wallboard panels 12 and 14 (FIG. 3) forming a corner 16, preferably a 90° corner, however other angles are contemplated and are contemplated to be at least in the range of 75°-105°. It is also contemplated that the present strip 10 is mountable on walls with a range of angular configurations between about 30° to 180°.

Advantages of the present corner bead strip 10 include that it is made of flexible plastic having two distinct compositions, a first composition in a first region, and a second composition in a second region, the second composition being more flexible than the first composition. Also, the present corner bead strip 10 has a particular geometry to facilitate secure engagement on the wallboard corner 16.

Included on the bead strip 10 is a body 18 having a first, preferably planar flange or wing 20 and a second, preferably planar flange or wing 22, both flanges being panel-like in configuration. The body 18 is made of flexible material, which in the present application means that the body is non-rigid and is rollable into a roll for facilitating shipping and handling and foldable, as opposed to being relatively rigid and self-supporting. Each flange 20, 22 has a corner edge 24 and an opposite free edge 26. The corner edges 24 are schematic only, and define a dividing line between two chemical compositions as will be described below.

Between the corner edges 24 is defined a flex zone 28, also referred to as a central strip, due to its location between the two flanges 20, 22. It will be appreciated that the body 18 is extruded, and the flex zone 28 and the flanges 20, 22 are formed at one time, however the flex zone 28 has a chemical composition that is distinct and non-homogenous from that of the flanges 20, 22.

As is known in the art, the flex zone 28 is the portion of the body 18 that will form the corner when the strip 10 is installed on the wall corner 16. The body 18 is preferably laminated to a web of paper 30, having edges 32 that extend beyond the free edges 26 of the flanges. The paper web 30 is secured by a layer of adhesive 34 to an outside surface 36 of the body 18. It is contemplated that the adhesive 34 is hot melt adhesive, fast-curing adhesive or the like, and is preferably applied to coat the entire outside surface 34 prior to applying the paper 30.

Referring to FIG. 1, in one embodiment, the flanges 20, 22 range from 0.5 to 2 inches in width, the flex zone 28 ranges from 0.05 to 0.25 inch in width, and the web of paper 30 extends past the free edges 26 of the flanges 20, 22 approximately 0.25 to 0.75 inch in width. All of the above widths refer to dimensions transverse to a longitudinal axis of the strip 10 (vertical dashed line in FIG. 1) which parallels an axis of the corner 16. As is known in the art, the paper 30 bonds readily to wallboard joint compound 38, used to attach the corner strip 10 to the wall corner 16.

Referring now to FIGS. 1 and 2, it will be seen that the flanges 20, 22 are preferably tapered to narrow towards the free edges 26, however, non-tapered, planar flanges are also contemplated. In one embodiment, a thickness of the flange 20, 22 near the corner edge 24 is in the general range of 0.40 to 0.55 inch, and near the free edge 26 is in the general range of 0.010 to 0.035 inch, and more preferably 0.015-0.035 inch, which includes the thickness of the paper 30 and the adhesive 34.

The body 18 is coextruded, meaning that the flanges 20, 22, are made of a first plastic having a first composition, and the flex zone 28 is made of a second plastic having a second composition distinct from the first composition. Nevertheless, the first and second plastics are provided to an extruder so that the resulting body 18 is an integral unit formed non-homogeneously. It is preferred that the flex zone 28 is made of a plastic composition that is relatively more flexible than the composition used to form the flexible flanges 20, 22. As a result, the flanges 20, 22 are more durable, and the flex zone 28 more readily conforms to the profile of the wall corner 16 to provide enhanced performance for wallboard finishing practitioners than has been available with conventional products. As needed, manufacturers can adjust the respective properties of the first and second compositions to suit particular applications. Such properties include flexibility, durability, impact resistance, adhesion, cost, etc.

In one embodiment, the second composition used to form the flex zone 28 is actually the same plastic composition used to form the first composition, to which is added a flexibility-enhancing additive, such as an impact resistance modifier, or other additive known to skilled practitioners for increasing the flexibility of extruded plastic components. Alternately, the composition used to form the flanges 20, 22 can be made without designated stiffening fillers to form the flex zone 28. As known in the art, impact resistance modifiers improve flexibility and toughness. In one embodiment, the first plastic composition is polyethylene terephthalate, commonly referred to as PET, and more specifically a modified version is polyethylene terephthalate Glycol-modified is used, also referred to as PET-G, which is known for enhanced molding properties. Alternatively other plastics are contemplated for forming the body 18, preferably of the type which is injection moldable or extrudable, including but not limited to polystyrene, polyvinylchloride (PVC), other variations of polyethylene (PET), and polycarbonate. In the present application, "plastic" will be understood to refer to any polymeric material, whether or not filled with fibers, minerals or other additives known in the art, including, but not limited to those materials identified above. In addition, the plastic is selected for impact resistance, and is reversibly deformable.

In another embodiment, the bead strip 10 has a body 18 made from PET, the flex zone 28 is also made from PET combined with an impact (flexibility) modifier, and has a total flange thickness of 0.050-0.055" near the corner edge 24, and 0.030-0.035" near the free edge 26. It should be noted that the total flange thickness includes 0.008-0.010" for the paper+glue thickness (30, 34 respectively in FIG. 2), so the plastic thickness near the free edge is 0.020-0.027 inch.

The preferred embodiment can be bent to a 90-degree angle and will hold the angle without relaxing back toward flat (180 degrees). The tape is rigid enough to support its own weight when an 8-foot length of material is bent to a 90 degree angle and held at one end in the V-up orientation, parallel to the ground. When the tape is bent to a 90-degree angle and fixed in the V-up position with 36 inches of material freely projecting into space parallel to the ground, the sample 10 stands essentially straight in a horizontal position. Then, when a 200-gram weight is placed at the free end of the 36-inch projecting length, the free end of the sample deflects (bends toward the ground) by 1.40-1.60 inches.

One concern of manufacturers of such products is that the two coextruded materials may not satisfactorily bond to each other. By using the same basic plastic for both the flanges 20, 22 and the flex zone 28, the bonding of the two compositions to each other in the extruder is facilitated. After formation of the body 18 by extrusion, the paper 30 is attached using adhesive, as described above.

Referring now to FIGS. 2 and 3, it will be seen that the flex zone 28 is configured to have a generally "V"-shaped recess 40 which facilitates the flexing of the corner bead strip 10 about the wall corner 16. The dimensions of the recess 40 may vary to suit the application. Also, while the bead strip 10 is depicted in FIGS. 2 and 3 as forming an outside corner, it is contemplated that the unit can optionally be formed into an inside corner, with the paper 30 still forming the outermost surface While particular embodiments of the present wallboard corner finishing strip have been described herein, it will be appreciated by those skilled in the art that changes and modifications may be made thereto without departing from the invention in its broader aspects and as set forth in the following claims.

What is claimed:

1. A corner bead strip for finishing a wallboard corner joint, comprising:

a flexible plastic body including a first flange and a second flange, each said flange having a corner edge and an opposite free edge, said corner edges being directly joined by a central flex zone encompassing a longitudinal axis of said strip, said flex zone being formed by a first plastic composition in a first region distinct from and more flexible that a second plastic composition in a second region used for forming said flanges, said first region provided with a "V"-shaped recess between said corner edges, said second region tapering toward each of said free edges, said flexible body being configured for being bendable about said axis to a 90-degree angle, and retaining said bent angle without relaxing back to an initial flat position;

said first and second plastic compositions are taken from the group consisting of polystyrene, PVC, PET, and polycarbonate, and at least one of said compositions including a flexibility modifier; and a web of paper covering a surface of said body.

2. The corner bead strip of claim 1 wherein at least one of said flanges tapers in thickness from said rib edge to said free edge.

3. The corner bead strip of claim 2 wherein each said flange tapers and has a thickness in the range of 0.40-0.55 inch near said corner edge and a thickness in the range of 0.015-0.035 inch near said free edge, said thickness including dimensions of said paper and adhesive joining said paper to said flanges.

4. The corner bead strip of aim 1 wherein edges of said paper extend past said free edge of each of said flanges.

5. The corner bead strip of claim 1 wherein said flanges are made of a first plastic composition, and said flex zone is made of a second plastic composition including the first plastic composition combined with said flexibility modifier that is distinct from said first plastic composition.

6. The corner bead strip of claim 1 wherein said flex zone is provided with a "V"-shaped recess for enhancing conformation about a wall corner.

7. The corner bead strip of claim 1 wherein said plastic composition of said flex zone comprises polyethylene terephthalate glycol modified (PET-G).

8. A corner bead strip for finishing a wallboard corner joint, comprising:

a flexible plastic body including a first flange and a second flange, each said flange having a corner edge and an opposite free edge, said corner edges being directly joined by a central flex zone encompassing a longitudinal axis of said strip, said flex zone being formed by a first plastic composition in a first region distinct from and more flexible than a plastic composition used for forming said flanges; said flex zone in the first region is provided with a "V"-shaped recess for enhancing conformation about a wall corner, said flexible body being configured for being bendable to a 90-degree angle, and retaining said bent angle without relaxing back to an initial flat position, said first and second plastic compositions are taken from the group consisting of polystyrene, PVC, PET, and polycarbonate, and at least one of said compositions including a flexibility modifier;

a web of paper covering a surface of said body, wherein the web of paper is secured to the surface of said body with an adhesive layer; and each said flange in the second region tapers and has a thickness in the range of 0.40-0.55 inch near said corner edge and a thickness in the range of 0.015-0.035 inch near said free edge, said thickness including dimensions of said paper and adhesive joining said paper to said flanges.

* * * * *